US011052280B1

(12) United States Patent
Massner et al.

(10) Patent No.: US 11,052,280 B1
(45) Date of Patent: Jul. 6, 2021

(54) WEIGHT BEARING EXERCISE SYSTEM

(71) Applicant: NV Athletics, LLC., Houston, TX (US)

(72) Inventors: Brock Massner, Houston, TX (US); Mark Chiles, Yorba Linda, CA (US); Francois Martin, Cypress, TX (US); Marko Vujicic, Huntington Beach, CA (US); Greg Wallace, Mission Viejo, CA (US)

(73) Assignee: NV Athletics, LLC, Houston, TX (US)

( * ) Notice: Subject to any disclaimer, the term of this patent is extended or adjusted under 35 U.S.C. 154(b) by 110 days.

(21) Appl. No.: 16/409,421

(22) Filed: May 10, 2019

Related U.S. Application Data

(60) Provisional application No. 62/669,492, filed on May 10, 2018.

(51) Int. Cl.
*A63B 21/00* (2006.01)
*A63B 21/04* (2006.01)
*A63B 21/055* (2006.01)

(52) U.S. Cl.
CPC ..... *A63B 21/156* (2013.01); *A63B 21/00072* (2013.01); *A63B 21/0428* (2013.01); *A63B 21/0552* (2013.01); *A63B 21/4035* (2015.10); *A63B 2210/50* (2013.01); *A63B 2244/09* (2013.01)

(58) Field of Classification Search
CPC ..... A63B 21/156; A63B 21/4035; A63B 21/00072; A63B 21/0428; A63B 21/0552; A63B 2210/50; A63B 2244/09
See application file for complete search history.

(56) References Cited

U.S. PATENT DOCUMENTS

| | | | | |
|---|---|---|---|---|
| 7,169,093 | B2 * | 1/2007 | Simonson | A63B 21/152 482/103 |
| 9,802,072 | B2 | 10/2017 | Wehrell | |
| 2003/0017918 | A1 * | 1/2003 | Webb | A63B 21/0628 482/94 |
| 2019/0111305 | A1 * | 4/2019 | Robinson | A63B 21/0552 |

* cited by examiner

*Primary Examiner* — Nyca T Nguyen
*Assistant Examiner* — Andrew M Kobylarz
(74) *Attorney, Agent, or Firm* — Eric Karich; Karich & Associates

(57) ABSTRACT

An exercise system has an elongate rigid housing, and an elongate extension arm mounted via a pivot to a bottom end of the elongate rigid housing. A first pulley system is rotatably mounted to a fixed position of the elongate rigid housing. An adjustable mounting mechanism is mounted on the elongate rigid housing. A second pulley system is rotatably mounted on the adjustable mounting mechanism so that the second pulley system can be moved relative to the first pulley system, thereby adjusting the distance between the first pulley system and the second pulley system. An elastic cord extends back and forth between the first and second pulley systems, around the arm pulley of the elongate extension arm, and to a free end that may be used for performing exercises.

14 Claims, 9 Drawing Sheets

WEIGHT BEARING EXERCISE SYSTEM

CROSS-REFERENCE TO RELATED APPLICATIONS

This application for a utility patent claims the benefit of U.S. Provisional Application No. 62/669,492 filed 10 May 2018.

BACKGROUND OF THE INVENTION

Field of the Invention

This invention relates generally to exercise systems, and more particularly to an elastic resistance training apparatus that is adjustable to enable different levels of resistance for weight training.

Description of Related Art

The use of elastic resistance bands, and machines that utilize such bands, are well known in the art of weight training, and provide many benefits. Elastic resistance bands are becoming more popular for use in athletic training, physical rehabilitation and general fitness for people of all ages. Elastic resistance has many benefits with the most prominent being the fact that an elastic band can generate many times its weight in resistance and it can bend to compactly fit into very small spaces. Thus, elastic bands are an easily portable exercise means to provide resistance to human training movements when one end of an elastic band is attached to a trainee and the other end is anchored to a fixed object or opposing body part. Elastic bands have a resistance to weight ratio that can be hundreds of times greater than that of metal weight plates.

It is possible to increase the resistance provided by the elastic band by pre-stretching the band. The shorter the band is in its contracted state the greater the percent increase in resistance will be as a function of distance stretched. For example, if you take a one foot long, one quarter inch thick elastic band and anchor one end to a wall and hold the opposite end exactly eleven inches from the wall, the band provides no resistance because the twelve inch band is slack. However, if you stretch the twelve inch band one hundred percent (100%) out to 24 inches the resistance will go from 0 to about 10 pounds. If you stretch the band to two hundred percent of the slack length of the band of 12 inches out to 36 inches, the resistance will increase 150% to about 25 pounds, etc. The resistance required to stretch an elastic band may increase exponentially as the stretched length becomes a larger percentage of the slack length of the elastic band. The exponential increase in resistance as a function of distance stretched may be useful to many training applications.

Pearce, U.S. Pat. No. 9,192,802, teaches an exercise apparatus that includes at least two resistance bands which includes first and second axles each have a wheel assembly rotatably connected at an opposite end thereof. The axles are connected at each of the opposite ends by at least one of the resistance bands so that the apparatus operates in a rolling extending and collapsing motion within an elastic region. A pedal assembly is axially connected to the second axle. The pedal/foot supporting assembly is capable of supporting and securing both feet of the person so that the person is capable of exerting stress when gripping the first axle with the person's hands and pushing against the second axle with the person's feet while exercising in a substantially prone position.

Wehrell, U.S. Pat. No. 9,802,072, teaches an elastic resistance training apparatus for applying one or more lateral resistive loads to drive, swing, and other phases to participants while performing complex motions at low or high speeds to condition one's body to better and more quickly perform physical movements at high speeds. Elastic members may be used to generate resistance emanating from a ground-based or vertically-positioned apparatus. The elastic members may connect to one or more body parts simultaneously. The apparatus may be mechanically designed to fully retract the elastic members into the apparatus to maintain resistance while participants are in close proximity to the apparatus. The apparatus provides a plurality of self-contained elastic members and provides participants the ability to alter the vertical and horizontal positions of each elastic member's emanation point from the apparatus. This provides ability to control applied resistance vectors between the attachment point on the participant and the apparatus.

SUMMARY OF THE INVENTION

The present invention teaches certain benefits in construction and use which give rise to the objectives described below.

The present invention provides an exercise system having an elongate rigid housing and an elongate extension arm mounted via a pivot to a bottom end of the elongate rigid housing. A first pulley system is rotatably mounted to a fixed position of the elongate rigid housing. An adjustable mounting mechanism is mounted on the elongate rigid housing. A second pulley system is rotatably mounted on the adjustable mounting mechanism so that the second pulley system can be moved relative to the first pulley system, thereby adjusting the distance between the first pulley system and the second pulley system. An elastic cord extends back and forth between the first and second pulley systems, around the arm pulley of the elongate extension arm, and to a free end that may be used for performing exercises.

A primary objective of the present invention is to provide an exercise system having advantages not taught by the prior art.

Another objective is to provide an exercise system having an adjustable mounting mechanism for adjusting the distance between first and second pulley systems, so that a user may adjust the level of resistance for weight training.

A further objective is to provide an exercise system that is easy to use, and provides multiple resistance settings for enabling different exercises.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above-described drawing figures illustrate the invention, a weight bearing exercise system 10 wherein a user adjusts the distance between first and second pulley systems 70 and 72 to enable different levels of resistance for weight training. Adjustable positions of the system 10 provide an exponential increase in resistance as a function of distance that an elastic cord 60 is stretched.

Figure 1:
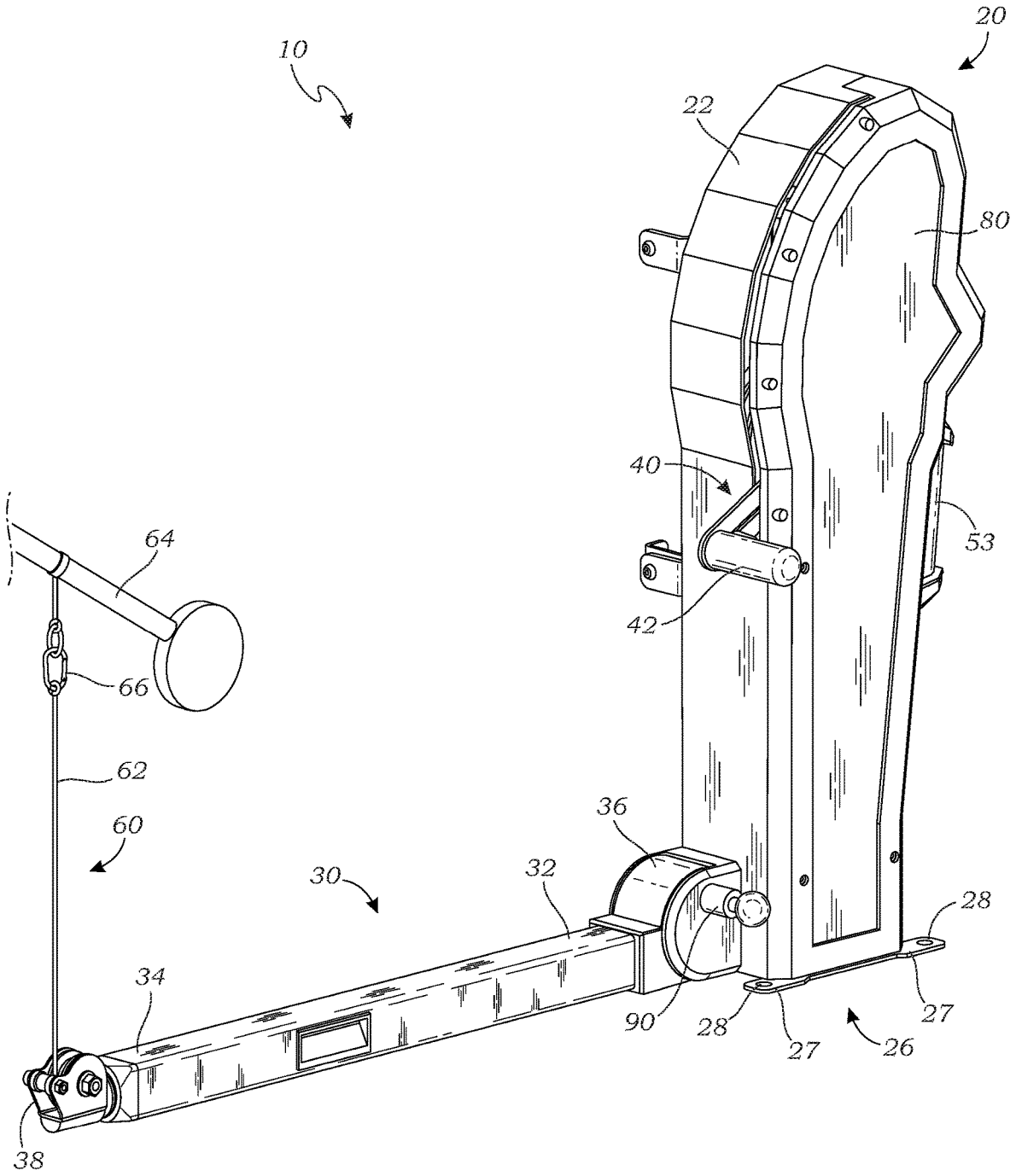
FIG. 1 is a front perspective view of an exercise system according to one embodiment of the present invention and being shown with a shroud.
Figure 2:
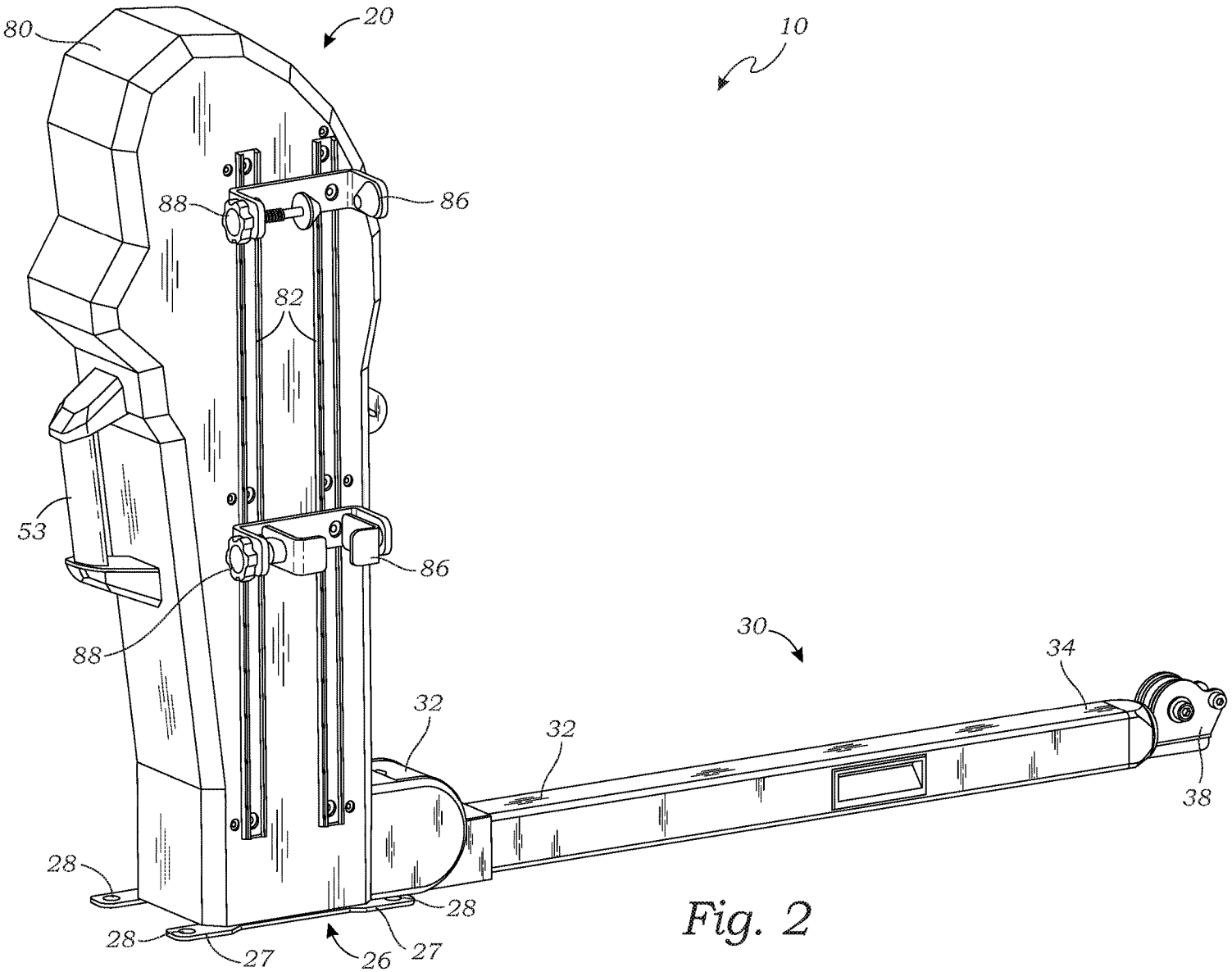
FIG. 2 is a rear perspective view of the exercise system.

FIG. 1 is a front perspective view of the exercise system 10 according to one embodiment of the present invention, shown with a shroud 80 for protecting internal components of the exercise system 10. FIG. 2 is a rear perspective view thereof. As shown in FIGS. 1-2, the exercise system 10 comprises an elongate rigid housing 20 and an elongate extension arm 30. The elongate rigid housing 20 extends from a top end 22 to a bottom end 24, the bottom end 24 having a base structure 26 for supporting the elongate rigid housing 20 in an upright orientation. In this embodiment, the base structure 26 further comprises a plurality of flanges 27 having apertures 28 for bolting the exercise system 10 to a desired surface, but in other embodiments, other methods of supporting the system 10 may be implemented, such as retaining hooks, weights, support frames, etc. The elongate rigid housing 20 also comprises a transport handle 53, and an adjustable mounting mechanism 40 having an adjustment handle 42, each described in greater detail below. The elongate extension arm 30 has a proximal end 32 and a distal end 34, the proximal end 32 being mounted via a pivot 36 to the bottom end 24 of the elongate rigid housing 20. As shown in FIG. 1, the pivot 36 includes a collapse mechanism 90 for pivoting the extension arm 30 toward the rigid housing 20, to terminate in a fully collapsed position (best shown in FIG. 9). The extension arm 30 additionally has an arm pulley 38 rotatably mounted on the distal end 34. The elastic cord 60 feeds through the rigid housing 20 and the extension arm 30 to a free end 62 at the arm pulley 38 of the extension arm 30, described in greater detail below.

In the embodiment of FIG. 1, the elastic cord 60 feed includes exercise handles 64 which are attached by a carabiner 66 to the free end 62 for performing exercises. In other embodiments, the elastic cord 60 may have other devices attached to the free end 62 (e.g., foot straps, belts, etc.), and may be connected to the free end 62 by any suitable means for attaching an exercise device, such as knots, hooks, grips, etc.

As shown in FIG. 2, the elongate rigid housing 20 includes a pair of laterally spaced channels 82 on a rear surface 84 of the housing 20. A plurality of locking brackets 86 are mounted on the laterally spaced channels 82 for mounting the exercise system 10 to a power rack. The brackets 86 further have adjustment knobs 88 for securing the exercise system 10 to a power rack. While one possible method of mounting the exercise system 10 to a power rack is shown, other methods of attachment may be utilized to the same effect, such as pegs, straps, hooks, etc.

Figure 3:
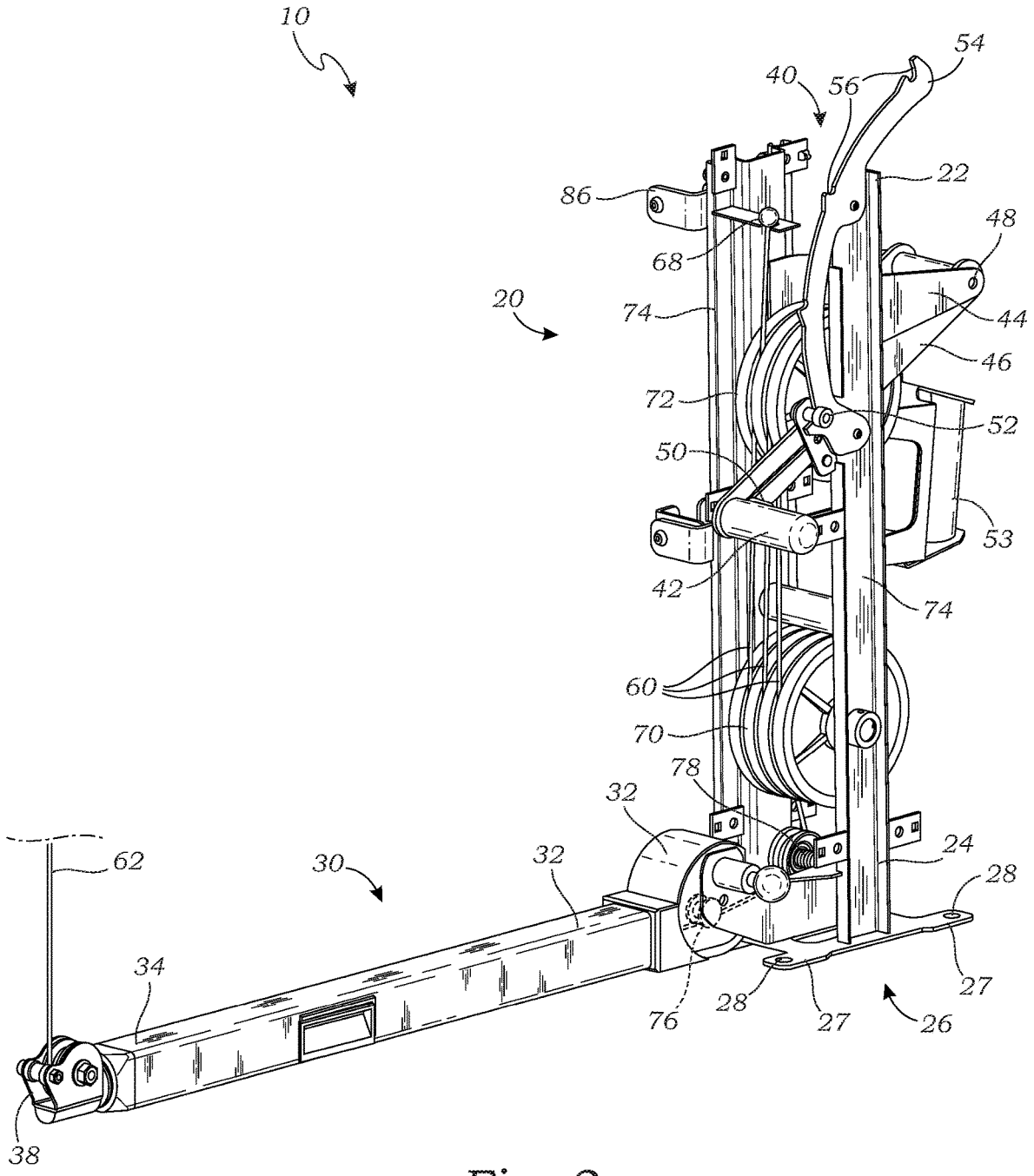
FIG. 3 is a front perspective view of the exercise system, illustrated without the shroud to show first and second pulley systems, with the second pulley system in a first position.

As shown in FIG. 3, the elongate rigid housing 20 comprises a pair of laterally spaced support frames 74 which house the first and second pulley systems 70 and 72. The first pulley system 70 has at least two pulleys rotatably mounted adjacent each other to a fixed position of the elongate rigid housing 20 adjacent the bottom end 24 of the elongate rigid housing 20. The second pulley system 72 has at least two pulleys, and is rotatably mounted on the adjustable mounting mechanism 40 so that the second pulley system 72 can be moved relative to the first pulley system 70, thereby adjusting a distance between them. Adjustment of the adjustable mounting mechanism also adjusts the resistance of the elastic cord. The elastic cord 60 extends from the free end 62 to an anchor end 68 fixedly attached to the top end 22 of the elongate rigid housing 20. The elastic cord 60 feeds back and forth between the first and second pulley systems 70 and 72, around each of the two at least pulleys of each of the first and second pulley systems, before extending out and around the arm pulley 38 of the elongate extension arm 30.

The adjustable mounting mechanism 40 which moves the second pulley system 72 comprises a mounting plate 44 fixedly mounted on the elongate rigid housing 20, the mounting plate 44 being connected to a swing arm 46 via a pivot 48. The swing arm 46 comprises the adjustment handle 42 with a trigger release 50, which controls a locking protrusion 52 of the swing arm 46. The locking protrusion 52 adjustably engages with a fixed arm 54 of the mounting mechanism 40. The fixed arm 54 may have an arcuate shape, and may include a plurality of locking notches 56 shaped to receive the locking protrusion 52 of the swing arm 46, such that a user may grasp the adjustment handle 42 to move the swing arm 46 upwardly and position the locking protrusion 52 within the locking notches 56, thereby increasing the distance and resistance between the first and second pulley systems 70 and 72. Alternatively, the user may grasp the adjustment handle 42 and depress the trigger release 50 to withdraw the locking protrusion 52, which allows the swing arm 46 to move downwardly, thereby decreasing the distance and resistance between the first and second pulley systems 70 and 72.

Figure 4:
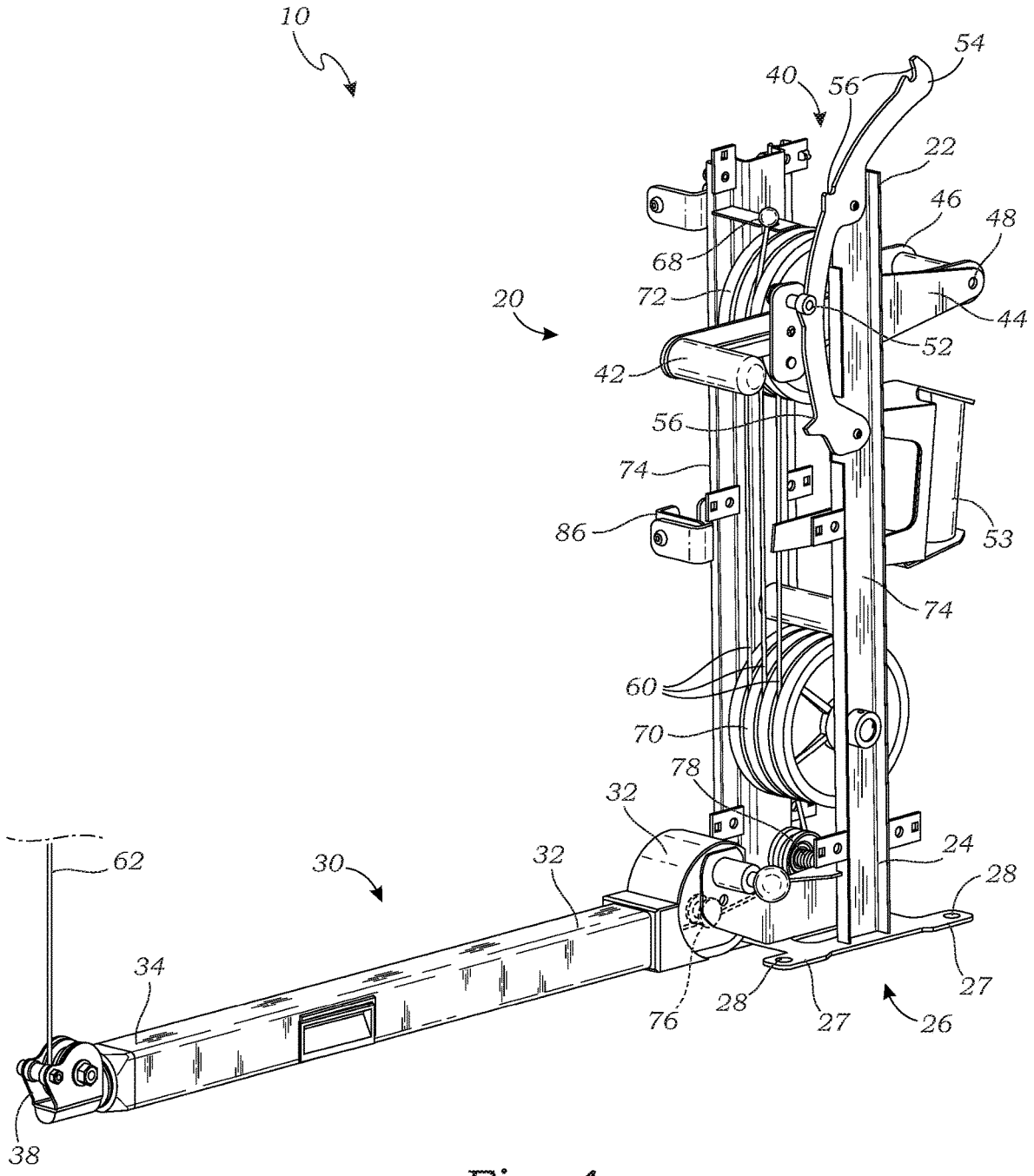
FIG. 4 is a front perspective view thereof, illustrating the second pulley system in a second position.
Figure 5:
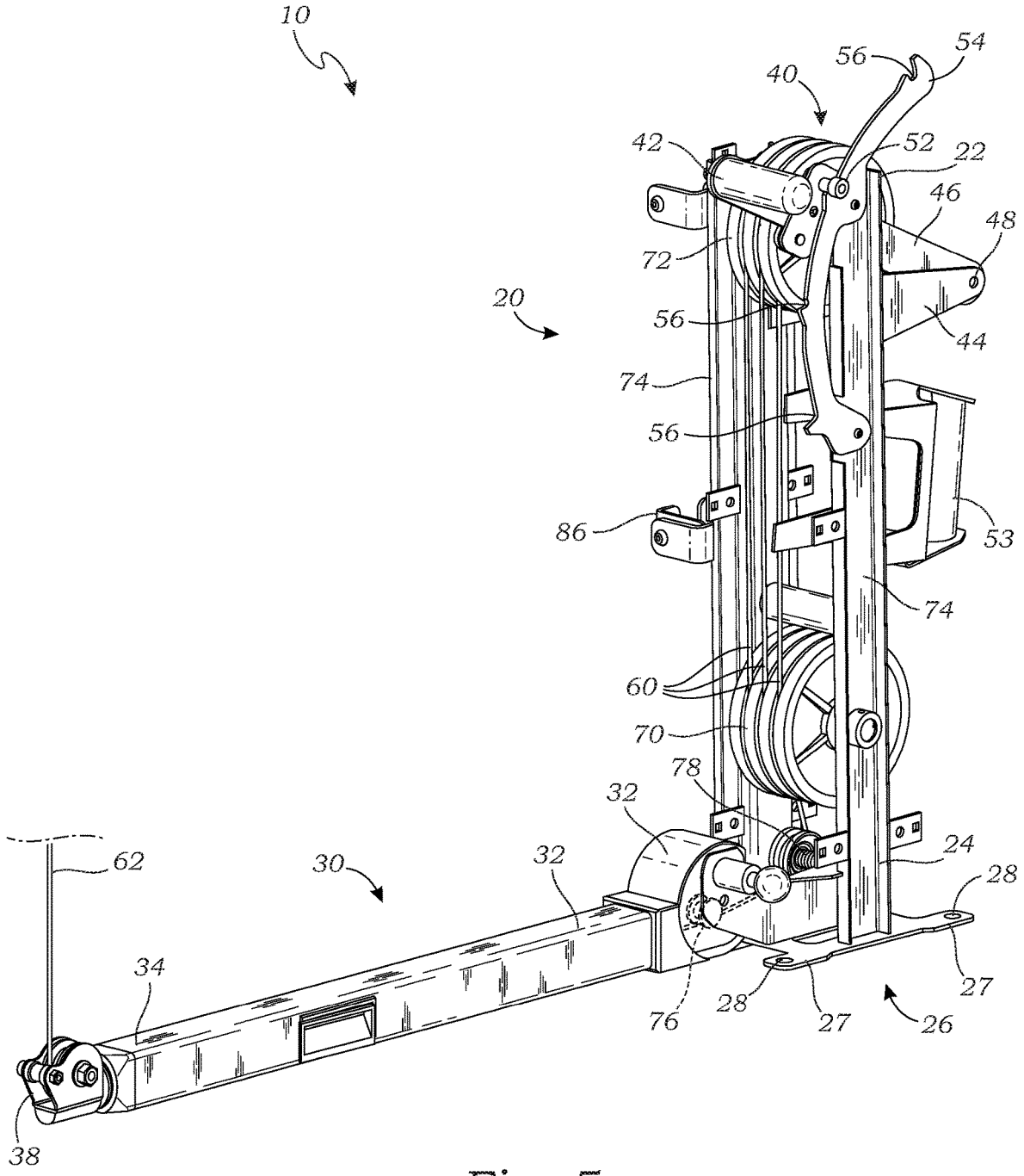
FIG. 5 is a front perspective view thereof, illustrating the second pulley system in a third position.
Figure 6:
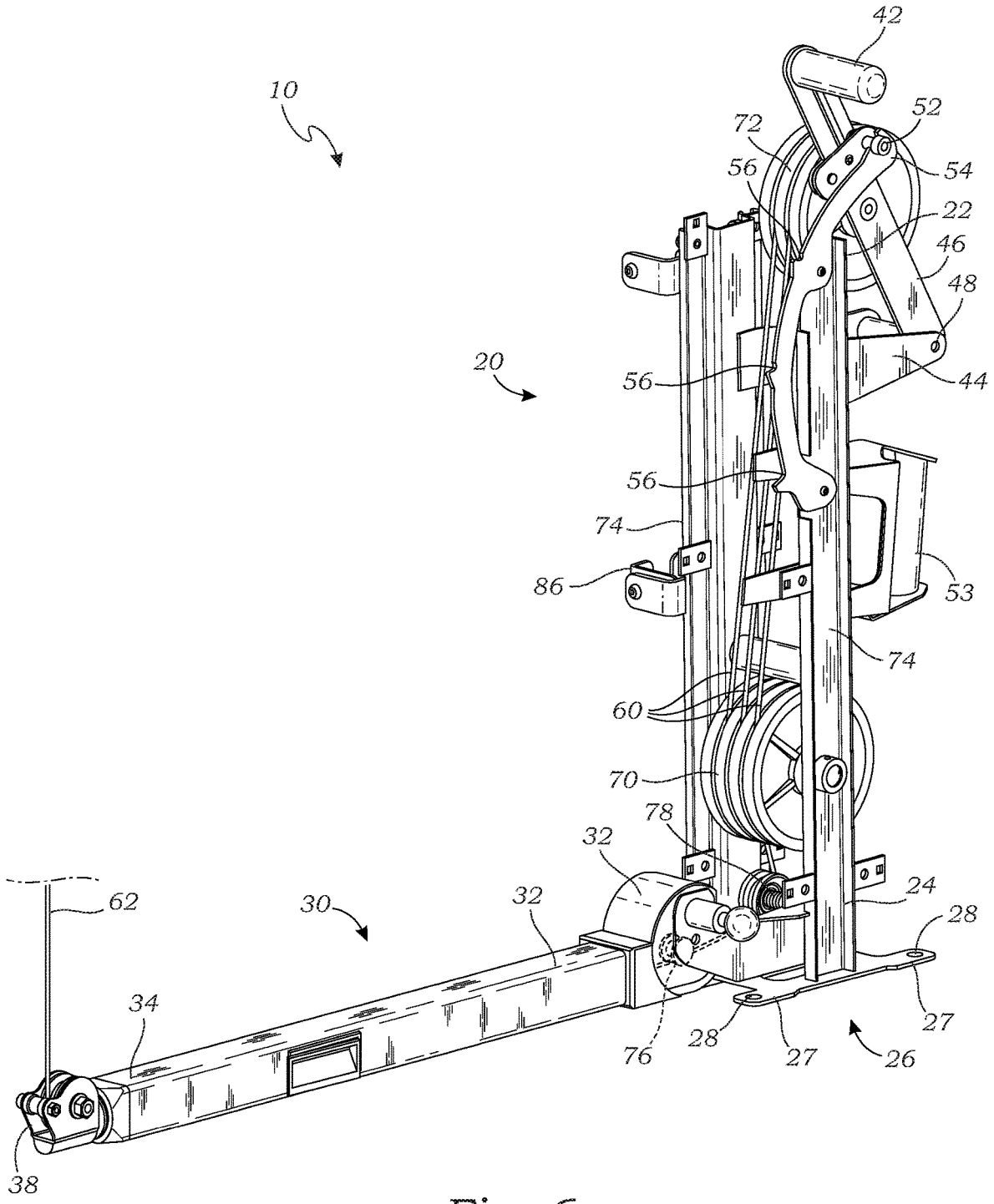
FIG. 6 is a front perspective view thereof, illustrating the second pulley system in a fourth position.

FIG. 3 illustrates the adjustable mounting mechanism 40 in a first position, and FIG. 4 illustrates the adjustable mounting mechanism 40 in a second position. FIG. 5 illustrates a third position, and FIG. 6 illustrates a fourth position. In this embodiment, four locking notches 56 are shown, meaning there are four possible positions and therefore degrees of resistance of the elastic cord 60. However, in other embodiments, the adjustable mounting mechanism 40 may have a greater or fewer number of locking notches, as deemed desirable by the manufacturer. Further, alternative methods of adjusting the distance between the first and second pulley systems 70 and 72 may be applied, such as removable pegs/pins, latches, etc.

Figure 7:
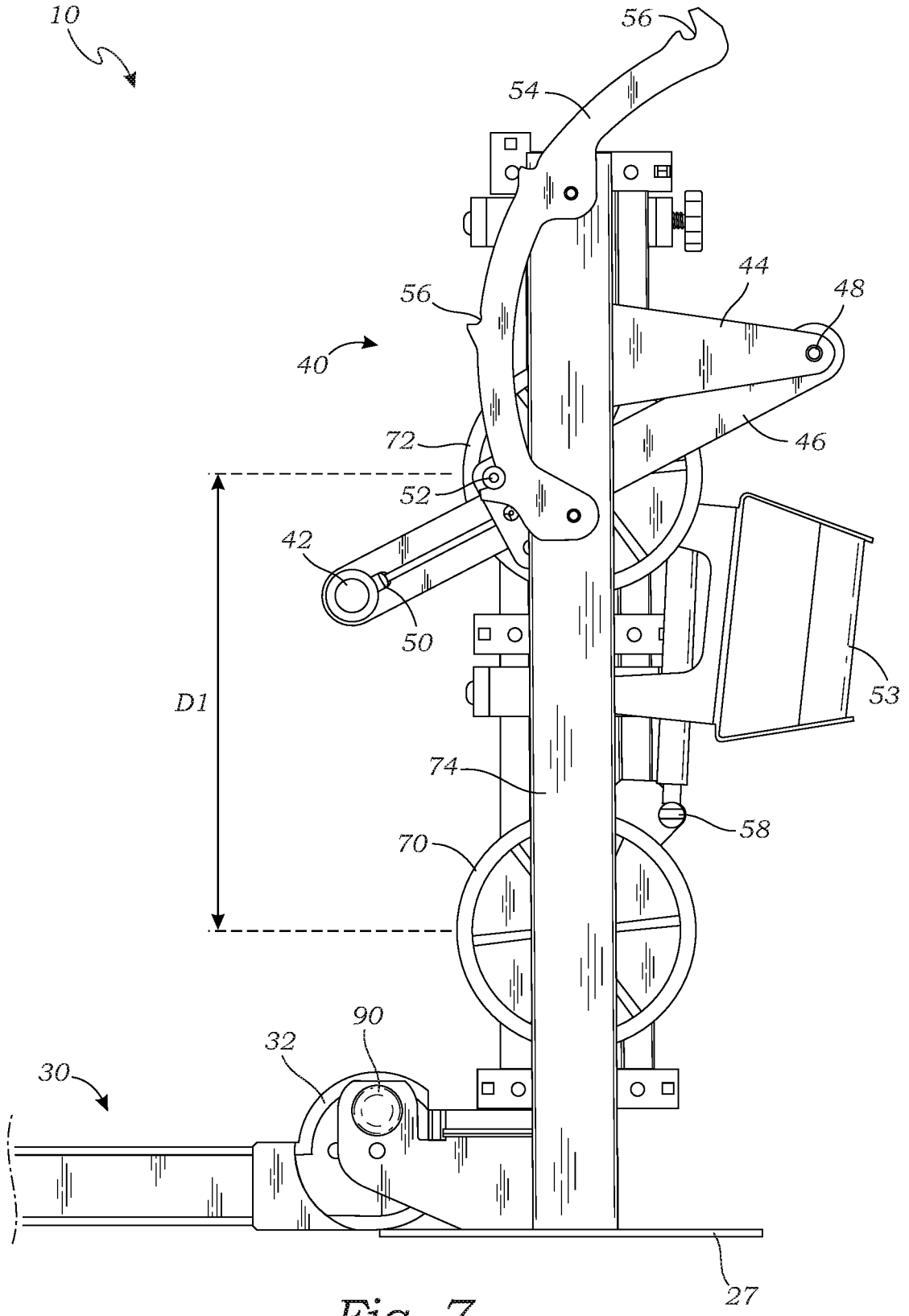
FIG. 7 is a side elevational view thereof in the first position.
Figure 8:
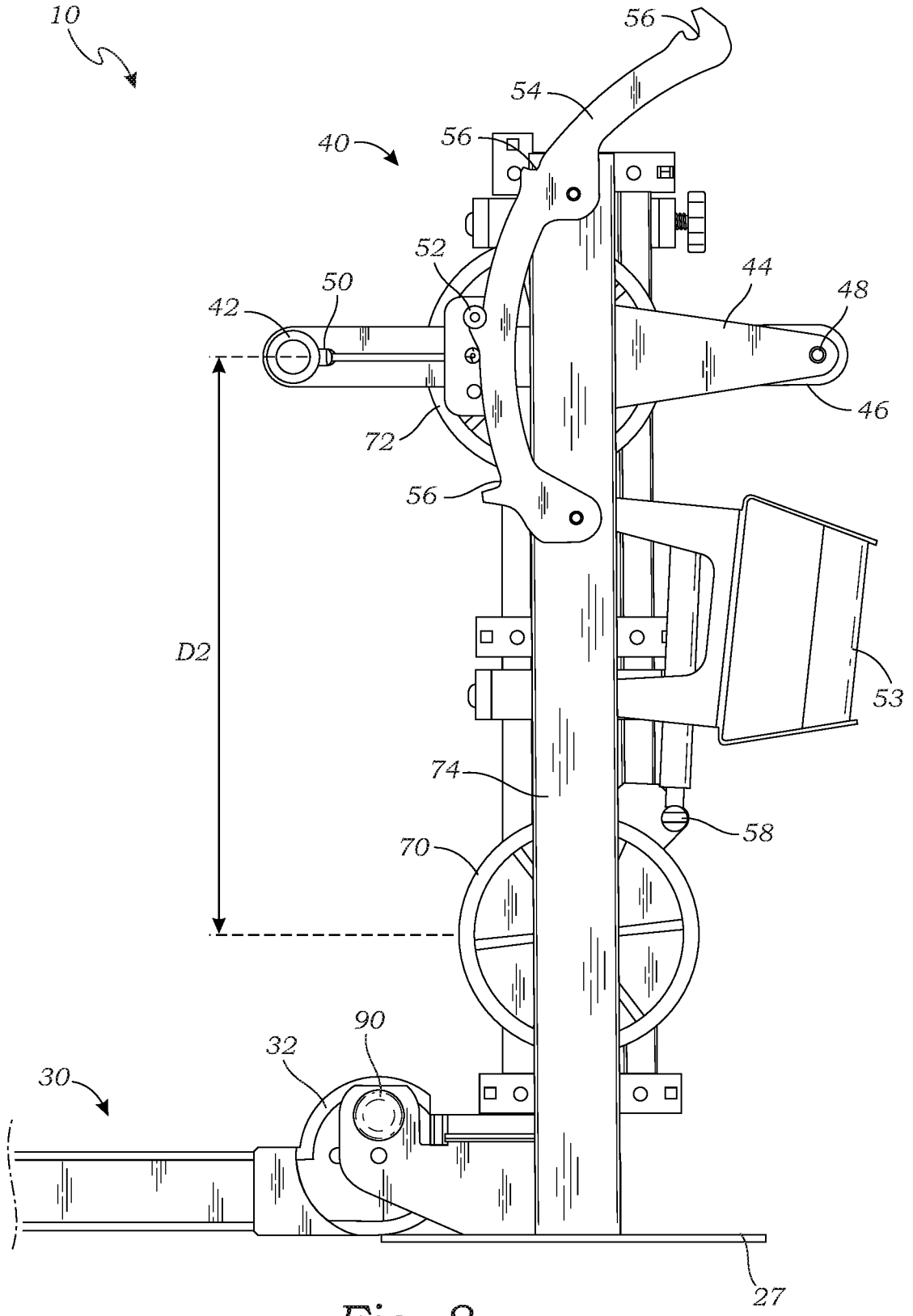
FIG. 8 is a side elevational view thereof, in the second position.

FIG. 7 is a side elevational view of the exercise system 10, showing the adjustable mounting mechanism 40 in the first position. FIG. 8 is a side elevational view of the exercise system 10 in the second position. In the first position of FIG. 7, the first and second pulley systems are separated by a first distance D1. In this position, the resistance exerted by the elastic cord 60 is at a lower level, for easier exercises. In the second position of FIG. 8, the first and second pulley systems are separated by a second distance D2. In this position, the resistance exerted by the elastic cord 60 is at a higher level, for more difficult exercises. As the distance is increased at higher settings, higher resistance levels are achieved. While two distances are shown, it should be understood that each subsequent position of the adjustable mounting mechanism 40 would express an increased resistance.

The exercise system 10 may further include a gas spring 58 connected to the swing arm 46 and the elongate rigid housing for dampening movement of the swing arm 46. In this embodiment, when a user wishes to lower the mounting mechanism 40, the gas spring 58 dampens the movement of the swing arm 46, so that the force of the elastic cord 60 being released, so that the swing arm 46 does not move abruptly and slam downwardly.

In another embodiment, the adjustable mounting mechanism may utilize alternative structures known in the art. Non-limiting examples include: any form of pivoting mechanisms or swing arms, with any form of adjustable locking structures known in the art; various forms of sliding adjustment mechanisms, tracks, channels, etc., known in the art; and other physical structures known to those skilled in the art, or which may be designed by one skilled in the art.

Figure 9:
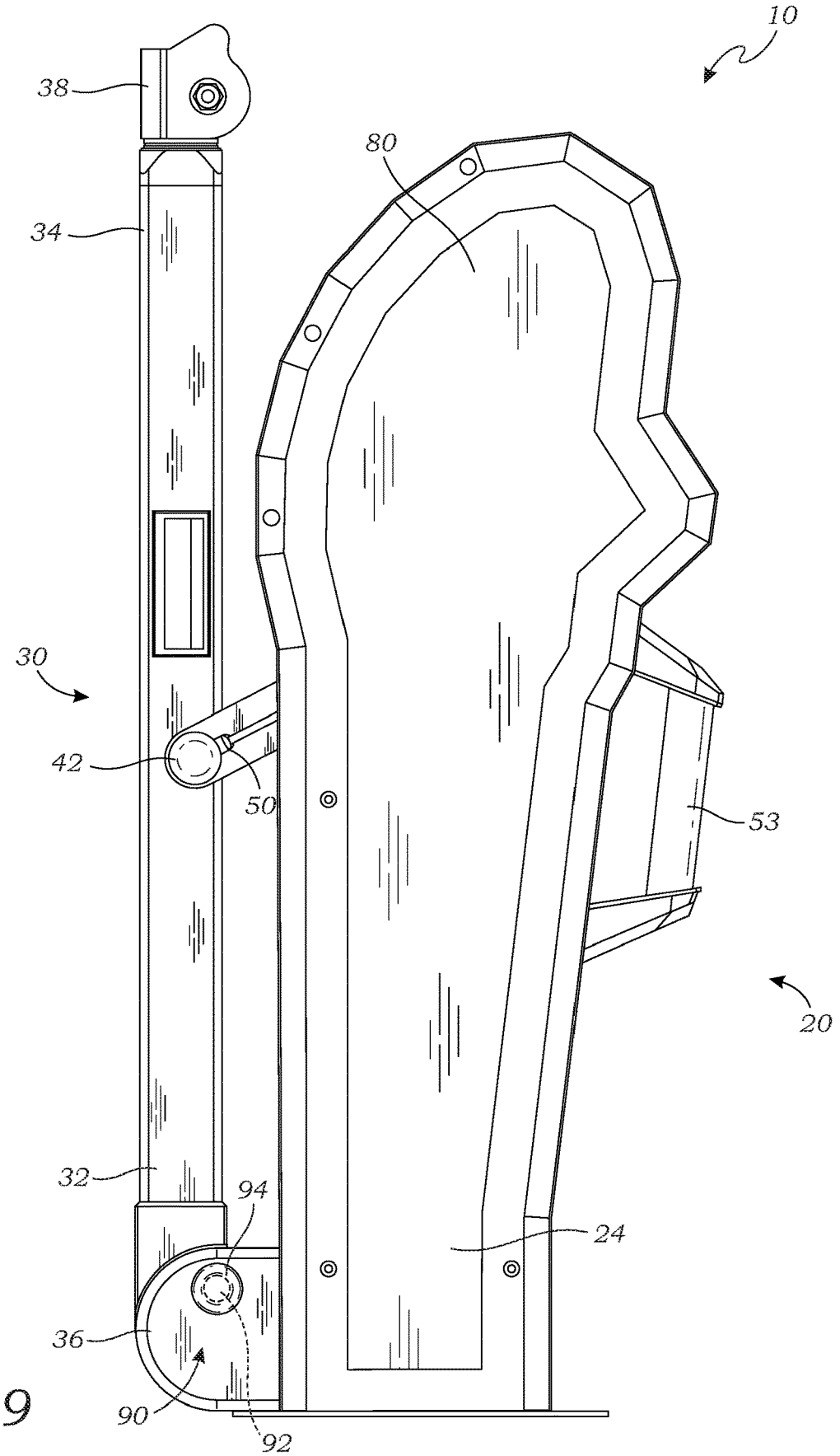
FIG. 9 is a side elevational view thereof, showing the present invention with the shroud and in a fully collapsed configuration.

FIG. 9 is a side elevational view of the exercise system 10 including the shroud 80 and in a fully collapsed configuration. As described above, the proximal end 32 of the elongate extension arm 30 is mounted via the pivot 36 to the bottom end 24 of the elongate rigid housing 20. The pivot 36 includes the collapse mechanism 90 for pivoting the extension arm 30 toward the rigid housing 20, to terminate in a fully collapsed position. In this embodiment, the collapse mechanism 90 comprises a locking spring 92 having a knob 94, the locking spring 92 capable of removable engagement with the proximal end 32 of the elongate extension arm 30. To fold the exercise system 10 into a fully collapsed configuration, a user may pull the knob 94, thus allowing the extension arm 30 to pivot toward the rigid housing 20. The knob 94 may be released to lock the exercise system 10 in the collapsed configuration, as the locking spring 92 will bias the collapse mechanism 90 into a locked position. From this configuration, a user may further grasp the transport handle 53 mounted on the elongate rigid housing 20 for easily transporting the exercise system 10.

As used in this application, the words "a," "an," and "one" are defined to include one or more of the referenced item unless specifically stated otherwise. The terms "approximately" and "about" are defined to mean+/−10%, unless otherwise stated. Also, the terms "have," "include," "contain," and similar terms are defined to mean "comprising" unless specifically stated otherwise. Furthermore, the terminology used in the specification provided above is hereby defined to include similar and/or equivalent terms, and/or alternative embodiments that would be considered obvious to one skilled in the art given the teachings of the present patent application. While the invention has been described with reference to at least one particular embodiment, it is to be clearly understood that the invention is not limited to these embodiments, but rather the scope of the invention is defined by claims made to the invention.

What is claimed is:

1. An exercise system comprising an elongate rigid housing that extends from a top end and a bottom end, the bottom end having a base structure for supporting the elongate rigid housing in an upright orientation;

a first pulley system having at least two pulleys rotatably mounted adjacent each other to a fixed position of the elongate rigid housing;

an adjustable mounting mechanism pivotally mounted on the elongate rigid housing;

a second pulley system having at least two pulleys rotatably mounted adjacent each other on the adjustable mounting mechanism so that the second pulley system can be moved relative to the first pulley system, thereby adjusting a distance between the first pulley system and the second pulley system;

an elongate extension arm having a proximal end and a distal end, the proximal end being mounted via a pivot to the elongate rigid housing;

an arm pulley rotatably mounted on the distal end of the elongate extension arm;

an elastic cord having an anchor end fixedly attached to the rigid housing, the elastic cord extending back and forth between the first and second pulley systems, around each of the at least two pulleys of each of the first and second pulley systems, before extending out and around the arm pulley of the elongate extension arm, and to a free end that may be used for performing exercises; and wherein adjustment of the adjustable mounting mechanism adjusts a resistance of the elastic cord.

2. The exercise system of claim 1, wherein the adjustable mounting mechanism comprises:

a mounting plate fixedly mounted on the elongate rigid housing;

a swing arm connected to the mounting plate via a pivot, the swing arm having a locking protrusion; and a fixed arm fixedly mounted to the elongate rigid housing, the locking protrusion adjustably engaging with the fixed arm for adjusting the position of the second pulley system to one of a plurality of predefined distances from the first pulley system.

3. The exercise system of claim 2, wherein the fixed arm includes a plurality of locking notches each shaped to receive the locking protrusion of the swing arm, such that the swing arm may be locked in different positions to adjust the distance between the first and second pulley systems.

4. The exercise system of claim 3, further comprising a gas spring connected to the swing arm and the elongate rigid housing for dampening movement of the swing arm.

5. The exercise system of claim 1, wherein the elongate rigid housing includes a pair of laterally spaced channels on a rear surface of laterally spaced support frames, the pair of laterally spaced channels having locking brackets adapted for mounting the exercise system to a power rack.

6. The exercise system of claim 1, wherein the elongate extension arm further includes first and second guide pulleys for guiding the elastic cord.

7. The exercise system of claim 1, wherein the free end of the elastic cord includes a carabiner.

8. An exercise system comprising an elongate rigid housing having a pair of laterally spaced support frames that extend from a top end and a bottom end, the bottom end having a base structure for supporting the elongate rigid housing in an upright orientation;

a first pulley system having at least two pulleys rotatably mounted adjacent each other to a fixed position of the elongate rigid housing;

an adjustable mounting mechanism pivotally mounted on the elongate rigid housing;

a second pulley system having at least two pulleys rotatably mounted adjacent each other on the adjustable mounting mechanism so that the second pulley system can be moved relative to the first pulley system, thereby adjusting a distance between the first pulley system and the second pulley system;

an elongate extension arm having a proximal end and a distal end, the proximal end being mounted via a pivot to the elongate rigid housing;

an arm pulley rotatably mounted on the distal end of the elongate extension arm;

an elastic cord having an anchor end fixedly attached to the rigid housing, the elastic cord extending back and forth between the first and second pulley systems, around each of the at least two pulleys of each of the first and second pulley systems, before extending out and around the arm pulley of the elongate extension arm, and to a free end that may be used for performing exercises;

wherein adjustment of the adjustable mounting mechanism adjusts a resistance of the elastic cord; and wherein the first and second pulley systems are positioned between the pair of laterally spaced support frames.

9. The exercise system of claim 8, wherein the adjustable mounting mechanism comprises:

a mounting plate fixedly mounted on the elongate rigid housing;

a swing arm connected to the mounting plate via a pivot, the swing arm having a locking protrusion; and a fixed arm fixedly mounted to the elongate rigid housing, the locking protrusion adjustably engaging with the fixed arm for adjusting the position of the second pulley system to one of a plurality of predefined distances from the first pulley system.

10. The exercise system of claim 9, wherein the fixed arm includes a plurality of locking notches each shaped to receive the locking protrusion of the swing arm, such that the swing arm may be locked in different positions to adjust the distance between the first and second pulley systems.

11. The exercise system of claim 10, further comprising a gas spring connected to the swing arm and the elongate rigid housing for dampening movement of the swing arm.

12. The exercise system of claim 8, wherein the elongate rigid housing includes a pair of laterally spaced channels on a rear surface of the laterally spaced support frames, the pair of laterally spaced channels having locking brackets adapted for mounting the exercise system to a power rack.

13. The exercise system of claim 8, wherein the elongate extension arm further includes first and second guide pulleys for guiding the elastic cord.

14. The exercise system of claim 8, wherein the free end of the elastic cord includes a carabiner.

* * * * *